US007123020B2

(12) United States Patent
Hill et al.

(10) Patent No.: US 7,123,020 B2
(45) Date of Patent: Oct. 17, 2006

(54) SYSTEM AND METHOD OF FAULT DETECTION IN A WARM AIR FURNACE

(75) Inventors: Bruce L. Hill, Roseville, MN (US); Rolf L. Strand, Crystal, MN (US); Michael W. Schultz, Elk River, MN (US)

(73) Assignee: Honeywell international Inc., Morristown, NJ (US)

( * ) Notice: Subject to any disclaimer, the term of this patent is extended or adjusted under 35 U.S.C. 154(b) by 282 days.

(21) Appl. No.: 10/878,222

(22) Filed: Jun. 28, 2004

(65) Prior Publication Data

US 2005/0284463 A1 Dec. 29, 2005

(51) Int. Cl.
*G01R 31/08* (2006.01)
*F24H 9/20* (2006.01)
*F23N 5/00* (2006.01)

(52) U.S. Cl. ..... 324/522; 126/116 A; 431/78

(58) Field of Classification Search ..... 324/522, 324/512, 500, 718, 713, 503, 502, 71.1, 511, 324/378, 380; 126/116 A; 431/75, 77, 78
See application file for complete search history.

(56) References Cited

U.S. PATENT DOCUMENTS

| | | | | |
|---|---|---|---|---|
| 4,238,185 | A | 12/1980 | Watson | 431/76 |
| 4,271,387 | A * | 6/1981 | Mukai et al. | 323/241 |
| 4,502,625 | A * | 3/1985 | Mueller | 236/11 |
| 4,607,787 | A | 8/1986 | Rogers, III | 236/11 |
| 5,043,655 | A * | 8/1991 | Anholm et al. | 324/73.1 |
| 5,520,533 | A | 5/1996 | Vrolijk | 431/90 |
| 5,590,642 | A | 1/1997 | Borgeson et al. | 126/116 A |
| 5,806,440 | A * | 9/1998 | Rowlette et al. | 110/162 |
| 5,902,099 | A | 5/1999 | Rowlette et al. | 431/22 |
| 5,910,875 | A * | 6/1999 | Tian et al. | 361/78 |
| 5,971,745 | A * | 10/1999 | Bassett et al. | 431/12 |
| 5,984,663 | A | 11/1999 | Joyce | 431/76 |
| 6,059,195 | A | 5/2000 | Adams et al. | 236/20 R |
| 6,535,838 | B1 | 3/2003 | Abraham et al. | 702/183 |
| 6,658,372 | B1 | 12/2003 | Abraham et al. | 702/183 |
| 6,914,434 | B1 * | 7/2005 | Bolz | 324/380 |
| 2002/0052713 | A1 | 5/2002 | Abraham et al. | 702/183 |
| 2003/0004682 | A1 | 1/2003 | Abraham et al. | 702/183 |

FOREIGN PATENT DOCUMENTS

GB 1597220 9/1981

OTHER PUBLICATIONS

Texas Instruments, "DiagnosTech Integrated Furnace Control," (Sep. 2003).

* cited by examiner

*Primary Examiner*—Diane Lee
*Assistant Examiner*—Hoai-An D. Nguyen
(74) *Attorney, Agent, or Firm*—Gregory M. Ansems

(57) ABSTRACT

A fault detection system and method for a warm air furnace is provided. A sensing circuit connected to an AC power source measures a level of current consumption during several points in the warm air furnace operating sequence. The measured level of current consumption is compared with an expected value. If the measured level exceeds the expected level by a threshold amount, a fault in the warm air furnace may be detected. An indication of at least one warm air furnace component that is most likely to have caused the fault may be provided.

45 Claims, 5 Drawing Sheets

SYSTEM AND METHOD OF FAULT DETECTION IN A WARM AIR FURNACE

FIELD

The present invention relates generally to warm air furnaces, and more particularly, to fault detection in a warm air furnace.

BACKGROUND

Many houses and other buildings use warm air furnaces to provide heat. Generally, these furnaces operate by heating air received through cold air or return ducts and distributing the heated air throughout the building using warm air or supply ducts. A circulation fan, operated by an alternating current (AC) permanent-split-capacitor (PSC) motor, directs the cold air into a heat exchanger, which may be composed of metal. The heat exchanger metal is heated using a burner that burns fossil fuels. The burner is ignited with an ignition device, such as an AC hot surface ignition element. The air is heated as it passes by the hot metal surfaces of the heat exchanger. After the air is heated in the heat exchanger, the fan moves the heated air through the warm air ducts. A combustion air blower, or inducer, is used to remove exhaust gases from the building. The inducer is typically operated using an AC shaded-pole motor.

Because furnaces play a critical role in the comfort of the occupants of the building, it is important that the warm air furnace remains functional. Therefore, it is desirable to detect faults in the warm air furnace prior to failure. This may prevent the occupants of the building from either remaining in an uncomfortably cold building or having to leave the building while waiting for a repair technician to fix the warm air furnace.

Therefore, a need exists to detect faults in a warm air furnace while the furnace is operating. Detecting faults in a warm air furnace while the furnace is operating may be beneficial for allowing an installer to verify proper furnace operation prior to leaving a site of installation, enabling predictive diagnostics for detecting deteriorating furnace elements prior to failure, and quickly detecting faults that have already occurred.

BRIEF DESCRIPTION OF THE DRAWINGS

Presently preferred embodiments are described below in conjunction with the appended drawing figures, wherein like reference numerals refer to like elements in the various figures, and wherein.

DETAILED DESCRIPTION

Figure 1:
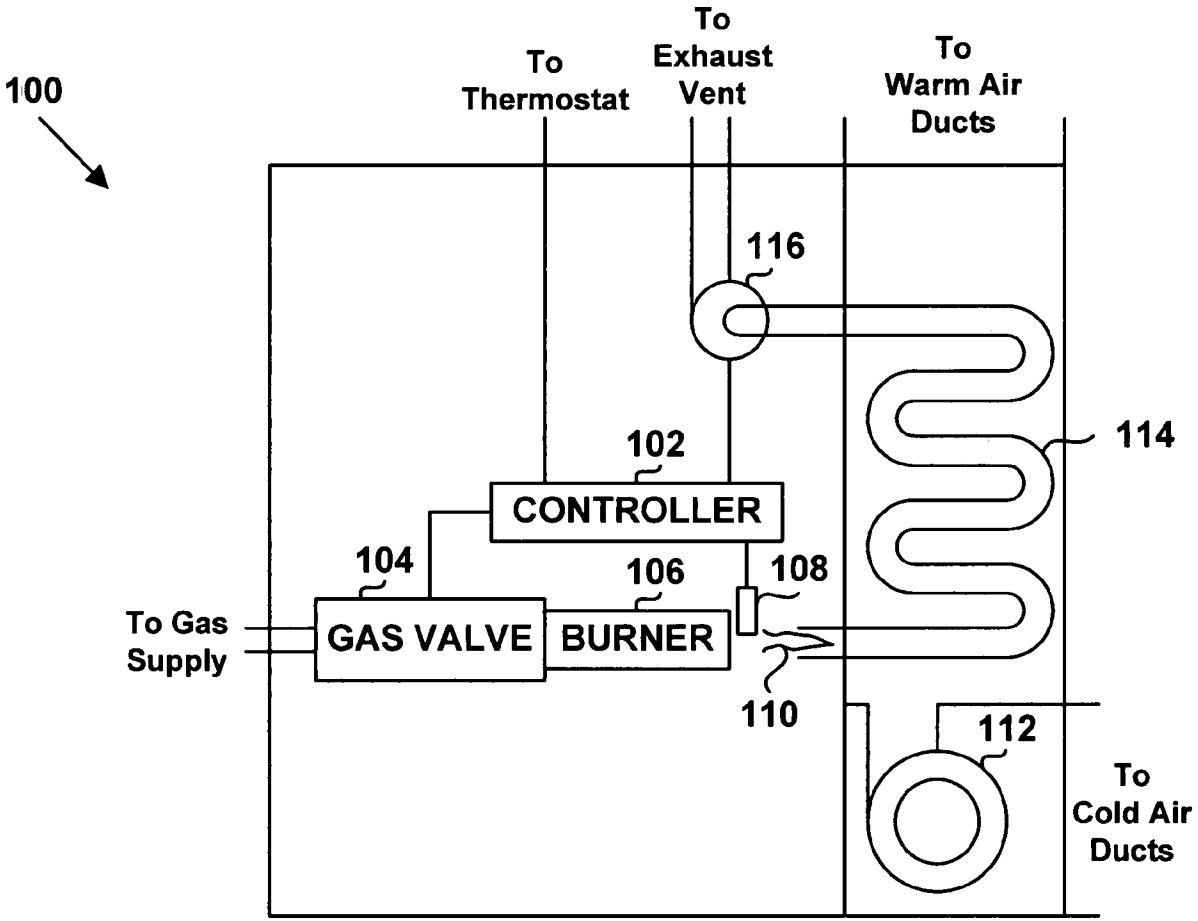
FIG. 1 is a block diagram of a warm air furnace, according to an embodiment.

FIG. 1 shows a simplified block diagram of a warm air furnace 100. The warm air furnace 100 includes a controller 102, a gas valve 104, a burner 106, an ignition element 108, a circulator fan 112, a heat exchanger 114, and a combustion air blower 116, which is also referred to as an inducer. The warm air furnace 100 may include additional components not shown in FIG. 1, such as sensors for detecting temperature and pressure, and filters for trapping airborne dirt.

Furthermore, warm air furnaces have various efficiency ratings. Additional components may be necessary to achieve different levels of efficiency.

The warm air furnace 100 depicted in FIG. 1 is fueled by natural gas. However, the warm air furnace 100 may be fueled by other fossil fuels, such as oil and propane. Different fuel sources may require different components in the warm air furnace 100. For example, a warm air furnace fueled by oil may include an oil pump.

The warm air furnace 100 may be connected to a thermostat, an exhaust vent, warm air or supply ducts, cold air or return ducts, and a gas supply. The warm air furnace 100 may also be connected to an alternating current (AC) power supply. The warm air furnace 100 may have at least one AC load. For example, the ignition element 108 may be an AC hot surface ignition element, the fan 112 may include an AC motor, such as an AC permanent-split-capacitor (PSC) motor, and the inducer 116 may include an AC motor, such as an AC shaded-pole motor. Other AC loads, such as a low poer transformer, may also be included in the warm air furnace 100.

Generally, the warm air furnace 100 operates as follows. The thermostat sends a "heat request" signal to the controller 102 when the thermostat is adjusted upwards. The controller 102 may perform a safety check, which may include checking a pressure switch located within the warm air furnace 100. (The pressure switch is not shown in FIG. 1.) Once the safety check is completed, the controller 102 may activate the inducer 116 by turning on an inducer motor, such as an AC shaded-pole motor. After turning on the AC shaded-pole motor, the controller 102 may verify that the pressure switch in the warm air furnace 100 closes. If the pressure switch closes properly, the controller 102 may then activate the ignition element 108.

The controller 102 may then open the gas valve 104, which may activate the burner 106. The burner 106 may mix the natural gas with air and burn the gas mixture. The ignition element 108 may ignite the gas mixture causing a flame 110 to develop. Once the flame 110 has been produced by the ignition element 108 and sensed by a flame sense rod (not shown in FIG. 1), the ignition element 108 may be deactivated. The flame 110 may warm metal in the heat exchanger 114.

After the heat exchanger 114 warms for a predetermined time, typically 15 to 30 seconds, the fan 112 may be activated. The fan 112 may direct cold air received from the cold air ducts into the heat exchanger 114. The heat exchanger 114 may separate the warm air from exhaust gases. The fan 112 may cause the warm air to exit the heat exchanger 114 through the warm air ducts, while the inducer 116 may cause the exhaust gases to exit through an exhaust vent connected to the outdoors.

The controller 102 may close the gas valve 104 when the thermostat setting has been reached. The inducer 116 may be deactivated after a predetermined time period, such as 30 seconds, to ensure that the exhaust gasses have been removed from the heat exchanger 114. The fan 112 may be deactivated after a predetermined time period, such as 120 seconds, to ensure the heat from the heat exchanger 114 is delivered to the warm air ducts. While the ignition element 108, the fan 112, and the inducer 116 are turned off, the warm air furnace 100 may be in an Idle mode.

During both the Idle mode and heating mode, it would be beneficial to monitor the warm air furnace 100 and potentially detect a fault condition prior to impacting the performance of the warm air furnace 100. In a preferred embodiment, a sensing circuit may be used to measure current consumption at various points during a warm air furnace 100 operating sequence.

Figure 2:
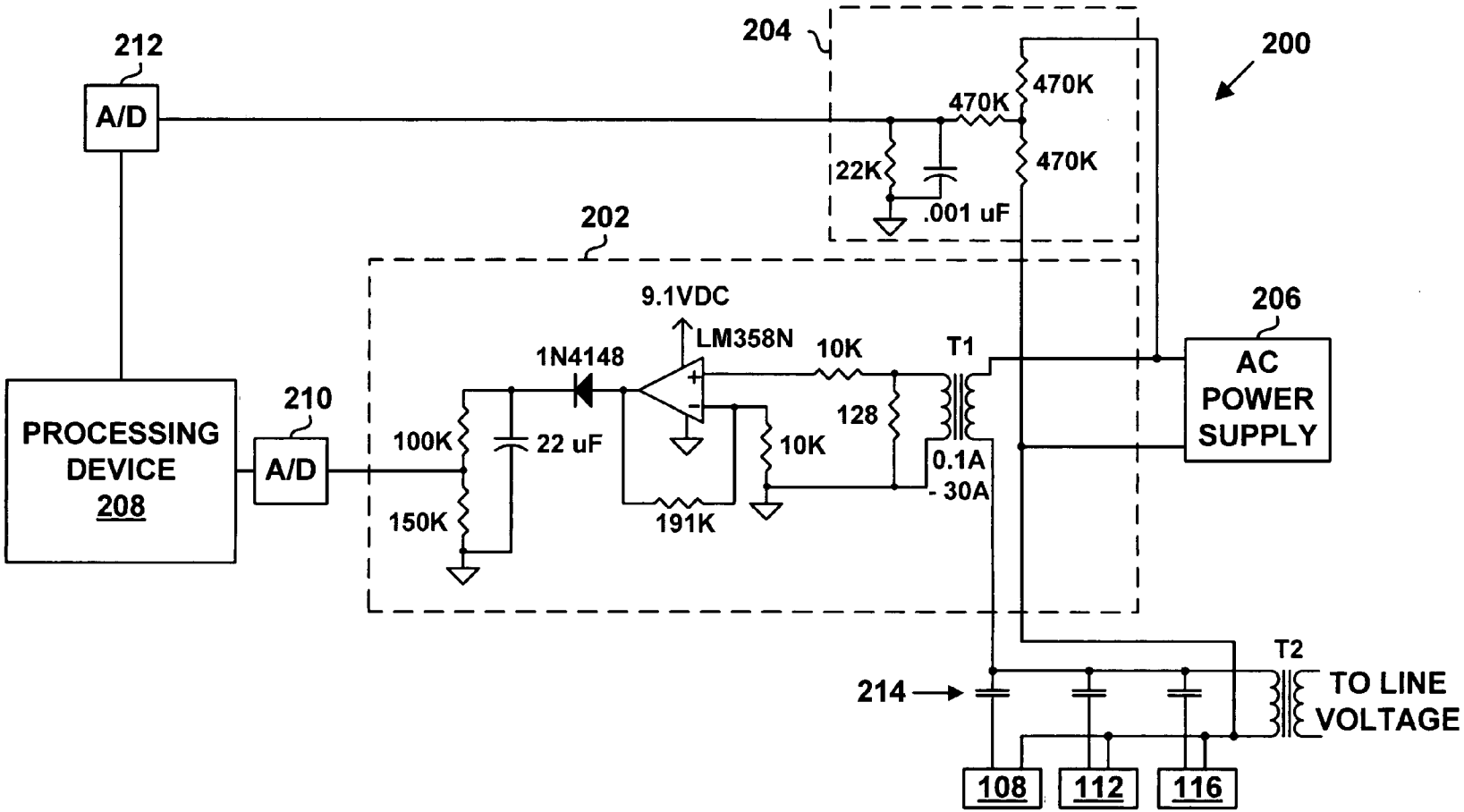
FIG. 2 is a schematic diagram of a sensing circuit, according to an embodiment.

FIG. 2 is a schematic diagram of a sensing circuit 200 according to a preferred embodiment. Other sensing circuits may be used. The sensing circuit 200 may be located within the controller 102. Alternatively, the sensing circuit 200 may be located separately or within another component of the warm air furnace 100.

The sensing circuit 200 may include a current sensing circuit 202. The current sensing circuit 202 may measure the current consumption of the warm air furnace 100 at various points in the warm air furnace 100 operating sequence. The current consumption may be indicative of normal operation, degradation, or failure of one or more components within the warm air furnace 100 depending on the amount of current detected at a particular point in the operating sequence of the warm air furnace 100.

The amount of current detected during normal operation of the warm air furnace 100 may depend on the amount of AC loading. The operational status of the ignition element 108, the fan 112, the inducer 116 and/or other AC loads, such as a low voltage transformer T2, may determine the amount of AC loading. For example, when the warm air furnace 100 is in the idle mode, the current consumption may depend on the AC load of the transformer T2, as the ignition element 108, the fan 112, and the inducer 116 may be deactivated.

A first input to the current sensing circuit 202 may be connected to the AC power supply 206 and a second input to the current sensing circuit 202 may be connected to the AC loads in the warm air furnace 100. Relay contacts 214 may open and close during the operation of the warm air furnace 100. When the relay contacts 214 are closed, the ignition element 108, the fan 112, and the inducer 116 may be AC loads in the warm air furnace 100. When the relay contacts 214 are open, the ignition element 108, the fan 112, and the inducer 116 may not be AC loads in the warm air furnace 100. The processing device 208 may independently open and close the relay contacts to switch the AC loads during the operation of the warm air furnace 100.

The current sensing circuit 202 may include a current transformer, shown in FIG. 2 as T1. An output of the current transformer T1 is an AC signal. An operational amplifier may be used to convert the AC signal into a DC voltage level. The operational amplifier is depicted in FIG. 2 as an LM358N from National Semiconductor of Santa Clara, Calif.; however, other operational amplifiers may be used.

An output of the current sensing circuit 202 representative of the DC voltage level may be connected to an analog to digital (A/D) converter 210. The A/D converter 210 may convert the analog DC voltage level to a digital representation of the DC voltage level. The digital representation of the DC voltage level may be proportional to the AC current flowing through the current sensing circuit 202. An output of the A/D converter 210 providing the digital representation of the DC voltage level may be connected to a processing device 208. Alternatively, the A/D converter function may be included within the processing device 208.

The sensing circuit 200 may also include a voltage sensing circuit 204. The voltage sensing circuit 204 may be used to measure current changes caused by applied voltage variations. The applied voltage variations may occur due to power fluctuations that naturally occur when delivering power to buildings. An output of the voltage sensing circuit may be used to offset the current consumption detected by the current sensing circuit 202 to account for current changes caused by the applied voltage variations.

A first input to the voltage sensing circuit 204 may be connected to the AC power supply 206 and a second input to the voltage sensing circuit 204 may be connected to the AC current loads in the warm air furnace 100. As a result, the voltage sensing circuit 204 may measure the AC voltage across the AC loads in the warm air furnace 100. The measured AC voltage is then divided and the peak voltage is provided as an output of the voltage sensing circuit 204.

The output of the voltage sensing circuit 204, which is representative of current changes caused by the applied voltage variations, may be connected to an A/D converter 212. Alternatively, the output of the voltage sensing circuit 204 may be connected to the A/D converter 210 (i.e., a single A/D converter may be used in the sensing circuit 200). The A/D converter 212 may convert the analog peak voltage signal to a digital signal that is proportional to the detected AC voltage across the AC loads. An output of the A/D converter 212 may be connected to the processing device 208. Alternatively, the A/D converter function may be included within the processing device 208.

The processing device 208 may be located within the controller 102 and provide other functions to the warm air furnace 100. Alternatively, the processing device 208 may be located separately from the controller 102 and/or be dedicated to detecting faults in the warm air furnace 100. In a preferred embodiment, the processing device 208 may be a microcontroller or a microprocessor. However, the processing device 208 may be any combination of hardware, firmware, and/or software operable to compare the measured current consumption levels with the expected current consumption levels during the warm air furnace 100 operating sequence.

The processing device 208 may receive an input from the current sensing circuit 202 that is representative of the current consumption of the warm air furnace 100. The processing device 208 may also receive an input from the voltage sensing circuit 204 that is representative of current changes caused by the applied voltage variations. The processing device 208 may adjust the input received from the current sensing circuit 202 using the input from the voltage sensing circuit 204 to determine a more accurate value of current consumption of the warm air furnace 100. In this manner, the processing device 208 may account for current changes caused by the applied voltage variations.

By knowing the expected current consumption during the warm air furnace 100 operating sequence, the actual current consumption value may be compared to the expected current consumption value. The actual current consumption value may be calculated by adjusting the current measured by the current sensing circuit 202 based on the voltage measured by the voltage sensing circuit 204.

The expected current consumption values may be determined during the design of the warm air furnace 100. The expected current consumption values may be established by determining typical current draw profiles at different points during the operating sequence of the warm air furnace 100. A tolerance may be determined to accommodate component and installation variations for these current draw profiles. Threshold values may be determined by understanding how components of the warm air furnace 100 fail and setting the threshold values to detect these failures.

Alternatively, the expected current consumption values may be determined during factory testing. Acceptable current limits may be programmed into factory test equipment. As a warm air furnace 100 is tested in the factory, the factory test equipment may use the acceptable current limits to identify failures in the warm air furnace 100 at the factory.

Additionally, the factory test equipment may monitor current and/or voltage levels during the operating sequence of the warm air furnace 100. These monitored current and/or voltage values may then be stored in the memory as the expected current consumption values for the particular warm air furnace 100 being factory tested. A tolerance may be determined to take into account installation variation on the expected current consumption values. The expected current consumption value plus the tolerance may be used as a threshold to determine if a component of the warm air furnace 100 is degraded or otherwise not functioning properly after the warm air furnace 100 is installed in the field. In this example, the expected current consumption values may be individually determined in the factory for each warm air furnace 100, which may allow for tighter control of the expected current consumption values than when the expected current consumption values are determined during the design of the warm air furnace 100.

Alternatively, the expected current consumption values may be determined during the installation of the warm air furnace 100. In this example, acceptable current limits are stored in memory prior to field installation. The acceptable current limits may be based on the warm air furnace design or determined during factory testing as described above. After the warm air furnace 100 is installed, the warm air furnace 100 may be operated as part of a commissioning run of the warm air furnace 100. During the commissioning run, current and/or voltage levels during the operating sequence of the warm air furnace 100 may be monitored and compared to the acceptable current limits. If the monitored current and/or voltage levels fall within a predetermined range, then the monitored current and/or voltage levels plus a tolerance may be stored in the memory and used as the expected current consumption values for that particular warm air furnace 100. In this example, the expected current consumption values may be individually determined in the field for each warm air furnace 100, which may allow for tighter control of the expected current consumption values than when the expected current consumption values are determined during factory testing.

The expected current consumption values may be determined at the factory and/or the site of installation by including a button on the warm air furnace 100. The button may be pressed at different points in the operational sequence of the warm air furnace 100 to cause the sensing circuit 200 to determine the current consumption values at those points. The processing device 208 may store the expected current consumption values received from the sensing circuit 200 in memory. Other methods of determining and storing the expected current consumption values may also be used.

The expected values of current consumption may be stored in memory. The memory may be located in the processing device 208 or may be located externally from the processing device 208. If the memory is located externally from the processing device 208, the processing device 208 may have access to the memory. The expected current consumption values may be stored in any type of memory, including, but not limited to, read-only memory (ROM), random-access memory (RAM), electrically erasable programmable read-only memory (EEPROM), and Flash memories.

If the actual value of current consumption is less than or exceeds the expected value of current consumption by a threshold amount, a fault may be detected. If a fault is detected, the processing device 208 may provide an indication of the fault. For example, the processing device 208 may cause a light to be set indicating the fault. As another example, the processing device 208 may activate an audible alarm to indicate the fault. As yet another example, the processing device 208 may communicate a fault to another device via a communication link. Additionally, if the fault may cause serious damage to a component of the warm air furnace 100, the processing device 208 may cause the warm air furnace 100 to shut down to prevent further damage to the component. Other fault indications may also be provided.

Additionally, the processing device 208 may identify at least one component in the warm air furnace 100 that is most likely to cause the fault. The processing device 208 may store a table in the memory that contains the potential faults and their associated likely causes. When a repair technician services the warm air furnace 100, the repair technician may be able to obtain an indication of what fault was detected and what components should be inspected in order to efficiently repair the warm air furnace 100.

Figure 3A:
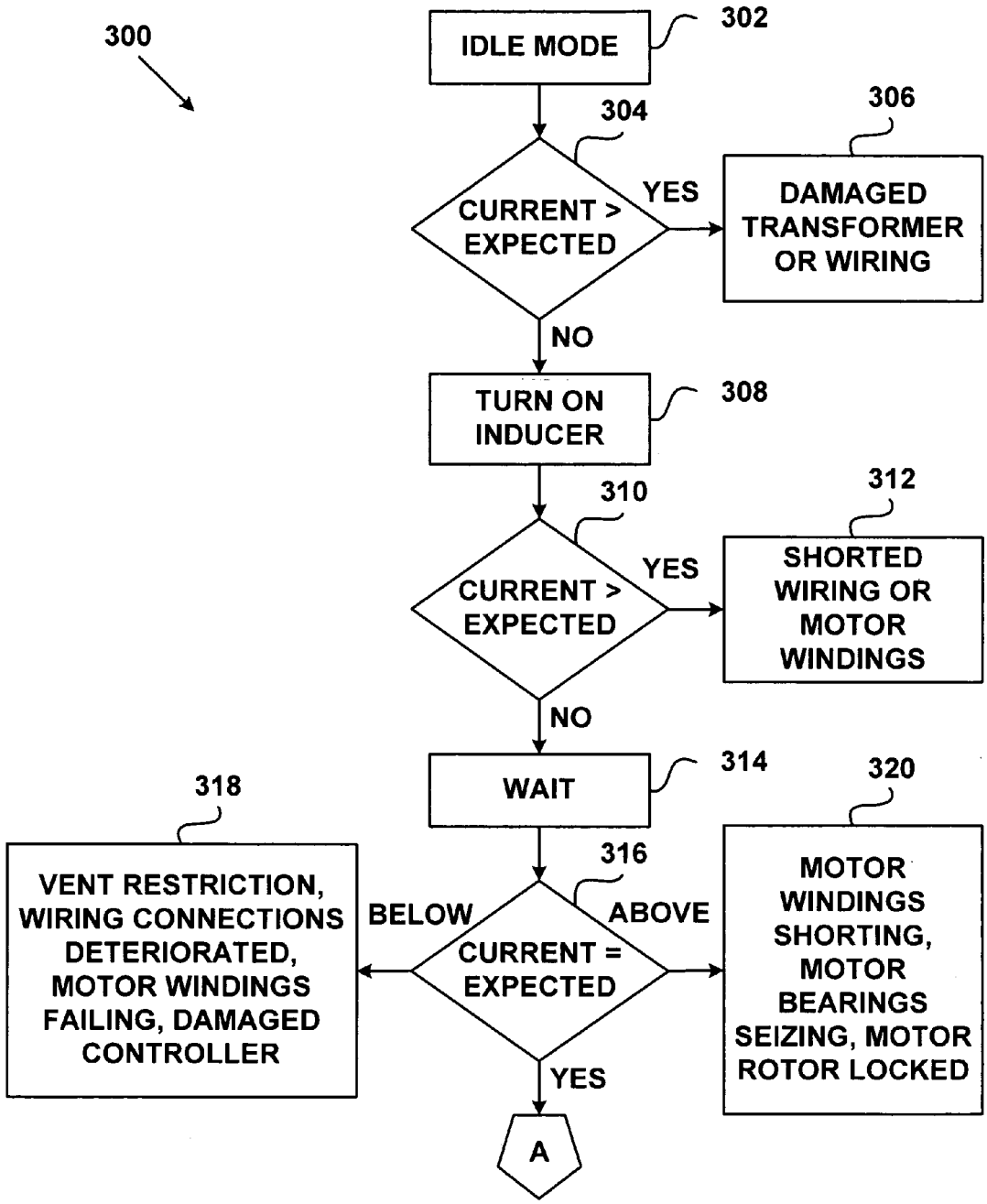
FIG. 3 is a flow chart of a fault detection method, according to an embodiment.
Figure 3B:
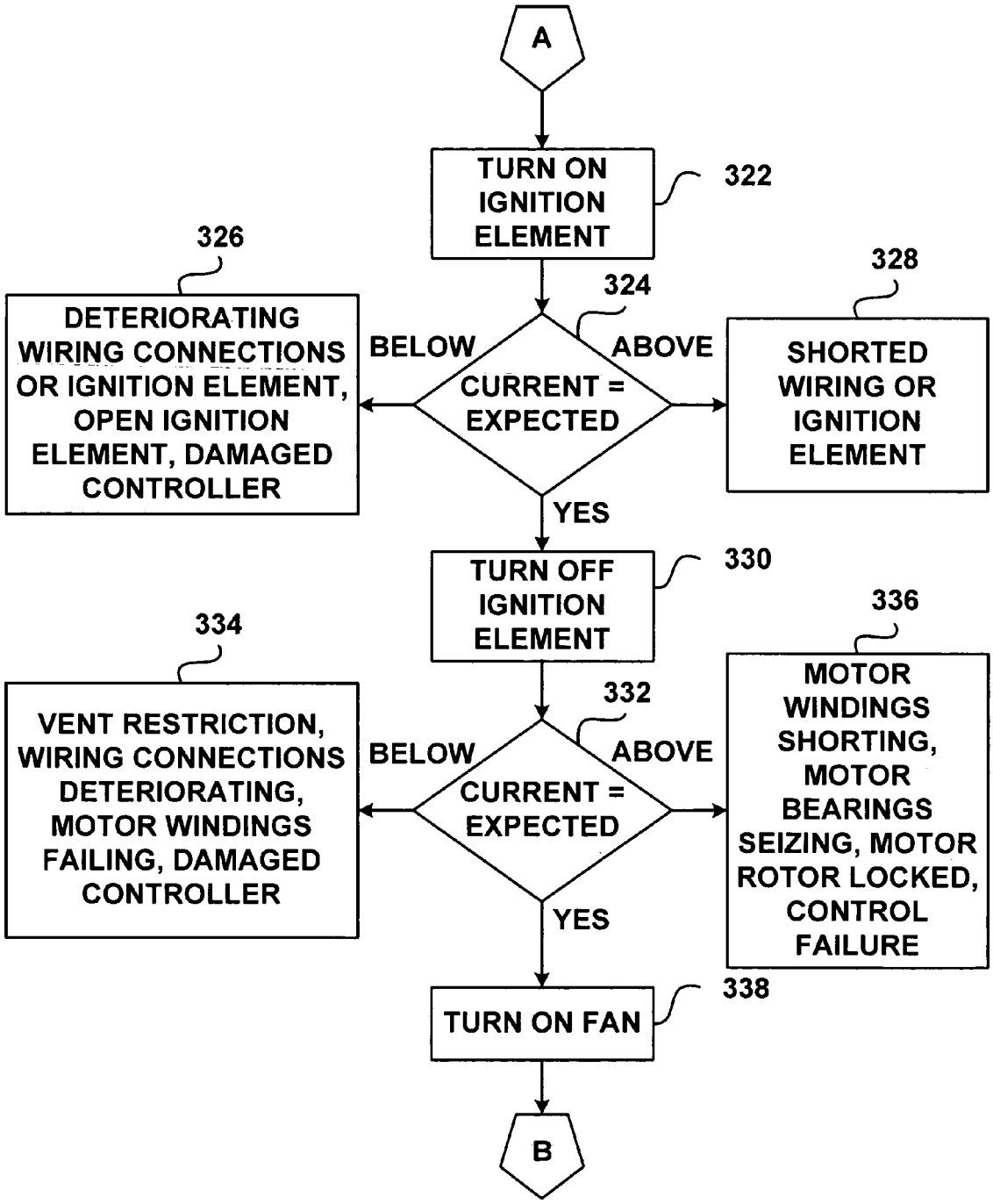
Figure 3C:
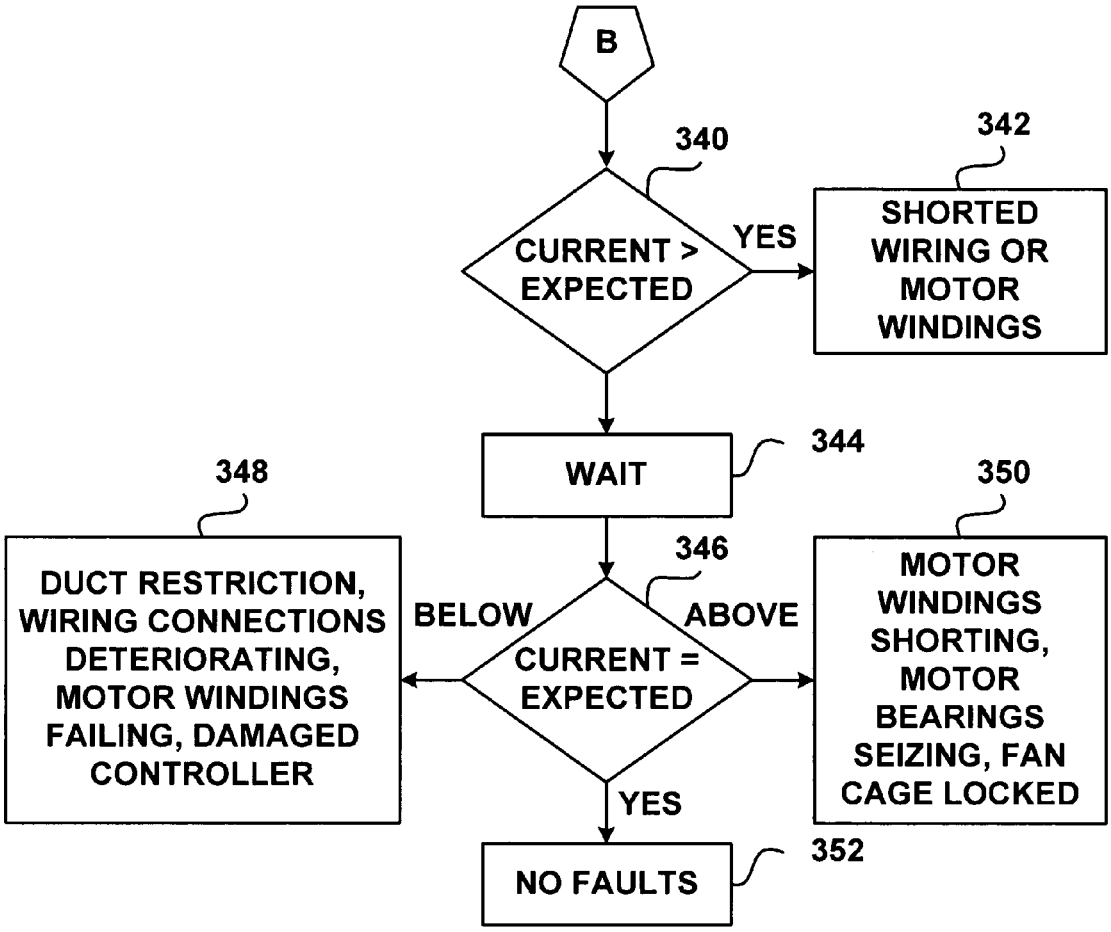

FIG. 3 is a flow chart of a fault detection method 300 that may be used to detect faults in the warm air furnace 100. The fault detection method 300 measures the level of current consumption at several points in the warm air furnace 100 operating sequence. The measured level of current consumption is adjusted to offset current changes caused by the applied voltage variations. The adjusted level of current consumption may be compared with an expected value of current consumption. If the comparison of the adjusted level to the expected level exceeds a threshold amount, a fault may be detected. The phrase "exceeds a threshold amount" as used in this specification includes the measured level being greater than or less than the expected level by the threshold amount. If a fault is detected, the method 300 may identify at least one warm air furnace component that is most likely to have caused the fault. However, other components may have caused the fault.

Not every test described in the method 300 needs to be run during every operational cycle of the warm air furnace 100. For example, some tests may be performed each time the warm air furnace 100 executes an operational cycle, while other tests may be performed less frequently. Additional tests may also be included in the method 300.

When the warm air furnace 100 is in the Idle mode 302, the ignition element 108, the fan 112, and the inducer 116 may be deactivated. During the Idle mode 302, a low current value may be supplied to the warm air furnace 100 due to the lack of current consumption by the ignition element 108, the fan 112, and the inducer 116. The sensing circuit 200 may take an "Idle" current reading 304 during the Idle mode 302. Alternatively, the sensing circuit 200 may take periodic Idle current readings 304 during the Idle mode 302. For example, the sensing circuit 200 may take the Idle current reading 304 every hour that the warm air furnace 100 remains in the Idle mode 302.

If the Idle current reading 304 obtained by the sensing circuit 200 is above an expected amount, there may be a problem with the warm air furnace 100. For example, during the Idle mode 302, the expected current reading may be approximately 0.2 amps. Other expected Idle current readings are possible and may be determined during the warm air furnace installation and/or set by the installer. For example, the expected current reading during Idle mode 302 may be approximately 6 amps if a Continuous Fan option is selected during installation.

If the Idle current reading 304 is above the expected amount by a threshold amount, such as 50% over the expected amount (i.e., more than 0.3 amps for an expected amount of 0.2 amps), there may be a fault in the warm air furnace 100. Other threshold amounts may be used.

As depicted in box 306, the fault may be caused by either a shorted and/or damaged low voltage transformer T2 in the AC power supply 202. Additionally or alternatively, shorted and/or damaged wiring from the AC power supply 202 to the warm air furnace 100 may have caused the fault. Other failure modes may also be possible. For example, the Idle current reading 304 may be above the expected amount due to a shorted load on the low voltage transformer. The processing device 206 may provide an indication of the fault in a manner that a repair technician would know to check for a shorted or damaged low voltage transformer T2 or wiring.

Once the thermostat sends a "heat request" signal to the warm air furnace 100, the controller 102 may perform a safety check, which may include checking a pressure switch located within the warm air furnace 100. Once the safety check is completed, the controller 102 may activate the inducer 116 by turning on the inducer motor, such as the AC shaded-pole motor as depicted in box 308.

The sensing circuit 200 may take an "Inducer Start" current reading 310 during a first period after the AC shaded-pole motor begins operation. If the Inducer Start current reading 310 obtained by the sensing circuit 200 is above an expected amount, there may be a problem with the warm air furnace 100. For example, during the first period after the AC shaded-pole motor begins operation, the expected current reading may be approximately 3 amps. Other expected Inducer Start current readings are possible. If the Inducer Start current reading 310 is above the expected amount by a threshold amount, such as 50% (i.e., more than 4.5 amps for an expected amount of 3 amps), there may be a fault in the warm air furnace 100. Other threshold amounts may be used.

As depicted in box 312, shorted wiring and/or motor windings in the inducer 116 may have caused the fault. Other failure modes may also be possible. The processing device 206 may provide an indication of the fault in a manner that a repair technician would know to check for shorted wiring or motor windings in the inducer 116.

After a wait period 314, the sensing circuit 200 may take an "Inducer Run" current reading 316 during a second period after the AC shaded-pole motor begins operation. The second period may be substantially 5 seconds after the first period. If the Inducer Run current reading 316 is above or below the expected amount, there may be a problem with the warm air furnace 100. For example, during the second period after the AC shaded-pole motor begins operation, the expected current reading may be approximately 2 amps. Other expected Inducer Run current readings are possible. If the Inducer Run current reading 316 is above or below the expected amount by a threshold amount, such as 50% (i.e., more than 3 amps or less than 1 amp for an expected amount of 2 amps), there may be a fault in the warm air furnace 100. Other threshold amounts may be used.

As depicted in box 318, if the Inducer Run current 316 is below the threshold amount, an excessive vent restriction, deteriorating wiring connections, failing or failed motor windings, and/or a damaged controller 102 may have caused the fault. Other failure modes may also be possible. The processing device 206 may provide an indication of the fault in a manner that a repair technician would know to check the appropriate warm air furnace 100 components.

As depicted in box 320, if the Inducer Run current reading 316 is above the threshold amount, motor windings may be beginning to short, motor bearings may be beginning to seize, and/or a rotor in the AC shaded-pole motor may be locked due to an obstruction. Other failure modes may also be possible. The processing device 206 may provide an indication of the fault in a manner that a repair technician would know to check the appropriate warm air furnace 100 components.

After turning on the AC shaded-pole motor, the controller 102 may verify that the pressure switch in the warm air furnace 100 closes. If the pressure switch closes properly, the controller 102 may then activate the ignition element 108, as depicted in box 322. The AC shaded-pole motor is still activated, so the sensing circuit 200 may detect a change in current consumption.

The sensing circuit 200 may take an "Ignition Element On" current reading 324 after the ignition element 108 is activated 322. If the Ignition Element On current reading 324 is above or below the expected amount, there may be a problem with the warm air furnace 100. For example, the expected current reading may be approximately 6 amps. Other expected Ignition Element On current readings are possible. If the Ignition Element On current reading 324 is above or below the expected amount by a threshold amount, such as 50% above or below the expected amount (i.e., more than 9 amps or less than 3 amps for an expected reading of 6 amps), there may be a fault in the warm air furnace 100. Other threshold amounts may be used.

As depicted in box 326, if the Ignition Element On current reading 324 is below the threshold amount, deteriorating wiring connections or ignition element 108, an open ignition element 108, and/or a damaged controller 102 may have caused the fault. Other failure modes may also be possible. The processing device 206 may provide an indication of the fault in a manner that a repair technician would know to check the appropriate warm air furnace 100 components.

As depicted in box 328, if the Ignition Element On current reading 324 is above the threshold amount, shorted wiring and/or ignition element 108 may have caused the fault. Other failure modes may also be possible. The processing device 206 may provide an indication of the fault in a manner that a repair technician would know to check the appropriate warm air furnace 100 components.

The controller 102 may open the gas valve 104 after a warm-up period following activation of the ignition element 108. Once ignition element 108 has ignited the flame 110, the ignition element 108 may be deactivated 330. The sensing circuit 200 may take another Inducer Run current reading 332. The Inducer Run current reading 332 may be substantially the same as the Inducer Run current reading 316.

As depicted in box 334, if the Inducer Run current 332 is below the threshold amount, an excessive vent restriction, deteriorating wiring connections, failing or failed motor windings, and/or a damaged controller 102 may have caused the fault. Other failure modes may also be possible. The processing device 206 may provide an indication of the fault in a manner that a repair technician would know to check the appropriate warm air furnace 100 components.

As depicted in box 320, if the Inducer Run current reading 332 is above the threshold amount, motor windings may be beginning to short, motor bearings may be beginning to seize, a rotor in the AC shaded-pole motor may be locked due to an obstruction and/or the ignition element 108 may have failed to turn off properly. Other failure modes may also be possible. The processing device 206 may provide an indication of the fault in a manner that a repair technician would know to check the appropriate warm air furnace 100 components.

After a delay period to allow the heat exchanger 114 to begin heating, the controller 102 may activate the fan 112, as depicted in box 338. The sensing circuit 200 may take a "Fan Start" current reading 340 during a first period after the fan motor, such as an AC PSC motor, begins operation. If the Fan Start current reading 340 obtained by the sensing circuit 200 is above an expected amount, there may be a problem with the warm air furnace 100. For example, during the first period after the AC PSC motor begins operation, the expected current reading may be approximately 25 amps. Other expected Fan Start current readings are possible. If the Fan Start current reading 340 is above the expected amount by a threshold amount, such as 50% over the expected amount (i.e., more than 37.5 amps for an expected current reading of 25 amps), there may be a fault in the warm air furnace 100. Other threshold amounts may be used.

As depicted in box 342, either shorted wiring and/or motor windings in the fan 112 may have caused the fault. Other failure modes may also be possible. The processing device 206 may provide an indication of the fault in a manner that a repair technician would know to check for shorted wiring or motor windings in the fan 112.

After a wait period 344, the sensing circuit 200 may take a "Fan Run" current reading 346 during a second period after the AC PSC motor begins operation. The second period may be substantially 30 seconds after the first period. If the Fan Run current reading 346 is above or below the expected amount, there may be a problem with the warm air furnace 100. For example, during the second period after the AC PSC motor begins operation, the expected current reading may be approximately 12 amps. Other expected Fan Run current readings are possible. If the Fan Run current reading 346 is above or below the expected amount by a threshold amount, such as 50% over the expected amount (i.e., more than 18 amps or less than 6 amps for an expected current reading of 12 amps), there may be a fault in the warm air furnace 100. Other threshold amounts may be used.

As depicted in box 348, if the Fan Run current reading 346 is below the threshold amount, a duct restriction, deteriorating wiring connections, failing or failed motor windings, and/or a damaged controller 102 may have caused the fault. Other failure modes may also be possible. The processing device 206 may provide an indication of the fault in a manner that a repair technician would know to check the appropriate warm air furnace 100 components.

As depicted in box 350, if the Fan Run current reading 346 is above the threshold amount, motor windings in the AC PSC motor may be beginning to short, motor bearings in the AC PSC motor may be beginning to seize, and/or a fan cage may be locked or obstructed. Other failure modes may also be possible. The processing device 206 may provide an indication of the fault in a manner that a repair technician would know to check the appropriate warm air furnace 100 components.

The controller 102 may close the gas valve 104 when the thermostat setting has been reached. The inducer 116 may be deactivated after a predetermined time period, such as 30 seconds, to ensure that the exhaust gasses have been removed from the heat exchanger 114. The fan 112 may be deactivated after a predetermined time period, such as 120 seconds, to ensure the heat from the heat exchanger 114 is delivered to the warm air ducts. The warm air furnace 100 may return to the Idle mode 302 and the sensing circuit 200 may take an Idle current reading 304.

If no faults have been detected 352, the warm air furnace 100 may be operational. The method 300 may be performed for each operating cycle of the warm air furnace 100. Alternatively, the method 300 may be performed on a periodic basis, such as once a day. Not all current readings need to be taken during each operating cycle of the warm air furnace 100. For example, some tests may be performed more than others based on failure rates of the warm air furnace components. It is also understood that additional current readings may be taken during the operation of the warm air furnace 100. While the most likely causes of the faults are provided in method 300, additional warm air furnace components may cause a fault.

It should be understood that the illustrated embodiments are exemplary only and should not be taken as limiting the scope of the present invention. For example, the invention may be used to detect faults in other ignition-controlled appliances, such as a water heater. The claims should not be read as limited to the described order or elements unless stated to that effect. Therefore, all embodiments that come within the scope and spirit of the following claims and equivalents thereto are claimed as the invention.

We claim:

1. A system for providing fault detection in an ignition-controlled appliance, comprising in combination:

an ignition-controlled appliance having an ignition element, an inducer, and a fan; and a sensing circuit operable to measure current consumption of the ignition-controlled appliance, wherein the measured current consumption of the ignition-controlled appliance depends on whether the ignition element, the inducer, and the fan are activated, and wherein the measured current consumption is used to diagnose an AC load failure in at least one of the ignition element, the inducer and the fan in the ignition-controlled appliance.

2. The system of claim 1, wherein the ignition-controlled appliance is a warm air furnace.

3. The system of claim 1, wherein the sensing circuit includes a current sensing circuit operable to measure current consumption.

4. The system of claim 3, wherein the sensing circuit further includes a voltage sensing circuit operable to measure current changes caused by applied voltage variations.

5. The system of claim 4, further comprising a processing device that receives an a first signal from the current sensing circuit and a second signal from the voltage sensing circuit, wherein the processing device is operable to calculate an adjusted measured current consumption by offsetting the first signal received from the current sensing circuit with the second signal received from the voltage sensing signal.

6. The system of claim 5, wherein the processing device compares the adjusted measured current consumption of the ignition-controlled appliance with an expected value of current consumption.

7. The system of claim 6, wherein the expected value of current consumption is established when designing the ignition-controlled appliance by determining current draw profiles at different points during an operating sequence of the ignition-controlled appliance.

8. The system of claim 6, wherein the expected value of current consumption is established during factory testing of the ignition-controlled appliance by monitoring current consumption levels during an operating sequence of the ignition-controlled appliance.

9. The system of claim 6, wherein the expected value of current consumption is established during installation of the ignition-controlled appliance by monitoring current consumption levels during an operating sequence of the ignition-controlled appliance.

10. The system of claim 6, wherein the processing device is operable to detect a fault in the ignition-controlled appliance if the comparison of the adjusted measured current consumption to the expected value of current consumption passes a threshold amount.

11. The system of claim 10, wherein the processing device provides an indication of the fault.

12. The system of claim 10, wherein the processing device identifies at least one component in the ignition-controlled appliance that is most likely to have caused the fault.

13. The system of claim 5, further comprising an analog to digital converter connected to an output of the current sensing circuit and an output of the voltage sensing circuit, wherein the analog to digital converter is operable to convert an analog signal representative of the current consumption received from the current sensing circuit into a first digital representation, wherein the analog to digital converter is operable to convert an analog signal representative of the current changes caused by the applied voltage variations received from the voltage sensing circuit into a second digital representation; and wherein the analog to digital converter provides the first and second digital representations to the processing device.

14. A system for providing fault detection in a warm air furnace, comprising in combination:

a warm air furnace including an ignition element, an inducer, and a fan;

a current sensing circuit operable to measure current consumption of the warm air furnace, wherein the measured current consumption of the warm air furnace depends on whether the ignition element, the inducer, and the fan are activated;

a voltage sensing circuit operable to measure current changes caused by applied voltage variations; and a processing device connected to an output of the current sensing circuit and an output of the voltage sensing circuit, wherein the processing device is operable to adjust the output of the current sensing circuit with the output of the voltage sensing circuit and compare an adjusted measured current consumption of the warm air furnace with an expected value of current consumption that is stored in memory, and wherein the processing device is operable to (i) detect a fault in the warm air furnace if the comparison passes a threshold amount, (ii) provide an indication of the fault, and (iii) identify at least one component in the warm air furnace that is most likely to have caused the fault.

15. A method for detecting a fault in a warm air furnace, comprising in combination:

measuring a level of current consumption during at least one operational stage of the warm air furnace wherein the level of current consumption of the warm air furnace depends on whether an ignition element, an inducer, and a fan are activated;

comparing the measured level of current consumption with an expected value of current consumption for the at least one operational stage; and detecting a fault in at least one of the ignition element, the inducer and the fan in the warm air furnace if the comparison exceeds a threshold amount.

16. The method of claim 15, further comprising adjusting the measured level of current consumption to account for current changes caused by applied voltage variations.

17. The method of claim 15, further comprising identifying at least one component in the warm air furnace most likely to have caused the fault.

18. The method of claim 15, wherein the at least one operational stage of the warm air furnace is selected from the group of modes consisting of Idle, Inducer Start, Inducer Run, Ignition Element On, Fan Start, and Fan Run.

19. The method of claim 15, wherein the at least one operational stage of the warm air furnace is an Idle mode.

20. The method of claim 19, wherein the warm air furnace is in the Idle mode when an ignition element, an inducer, and a fan in the warm air furnace are deactivated.

21. The method of claim 15, wherein the at least one operational stage of the warm air furnace is an Inducer Start mode.

22. The method of claim 21, wherein the warm air furnace is in the Inducer Start mode when an inducer in the warm air furnace is activated.

23. The method of claim 15, wherein the at least one operational stage of the warm air furnace is an Inducer Run mode.

24. The method of claim 23, wherein the warm air furnace is in the Inducer Run mode substantially 5 seconds after an inducer in the warm air furnace is activated.

25. The method of claim 15, wherein the at least one operational stage of the warm air furnace is an Ignition Element On mode.

26. The method of claim 25, wherein the warm air furnace is in the Ignition Element On mode when an ignition element in the warm air furnace is activated.

27. The method of claim 15, wherein the at least one operational stage of the warm air furnace is a Fan Start mode.

28. The method of claim 27, wherein the warm air furnace is in the Fan Start mode when a fan in the warm air furnace is activated.

29. The method of claim 15, wherein the at least one operational stage of the warm air furnace is a Fan Run mode.

30. The method of claim 29, wherein the warm air furnace is in the Fan Run mode substantially 30 seconds after a fan in the warm air furnace is activated.

31. The method of claim 15, wherein a current sensing circuit is operable to measure the level of current consumption during the at least one operational stage of the warm air furnace.

32. The method of claim 15, wherein a processing device is operable to compare the measured level of current consumption in the at least one operational stage of the warm air furnace with the expected value of current consumption for that at least one operational stage.

33. The method of claim 15, wherein the expected value of current consumption is established when designing the warm air furnace by determining current draw profiles at different points during an operating sequence of the warm air furnace.

34. The method of claim 15, wherein the expected value of current consumption is established during factory testing of the warm air furnace by monitoring current consumption levels during an operating sequence of the warm air furnace.

35. The method of claim 15, wherein the expected value of current consumption is established during installation of the warm air furnace by monitoring current consumption levels during an operating sequence of the warm air furnace.

36. A method for detecting a fault in a warm air furnace, comprising in combination:

measuring a first level of current consumption during an Idle mode of the warm air furnace;

comparing the first level of current consumption with a first expected level of current consumption;

detecting a fault in the warm air furnace if the comparison passes a first threshold amount;

measuring a second level of current consumption after activating an inducer in the warm air furnace;

comparing the second level of current consumption with a second expected level of current consumption;

detecting a fault in the warm air furnace if the comparison passes a second threshold amount;

measuring a third level of current consumption after the inducer has been operating substantially longer than 5 seconds;

comparing the third level of current consumption with a third expected level of current consumption;

detecting a fault in the warm air furnace if the comparison passes a third threshold amount;

measuring a fourth level of current consumption after activating a ignition element in the warm air furnace;

comparing the fourth level of current consumption with a fourth expected level of current consumption;

detecting a fault in the warm air furnace if the comparison passes a fourth threshold amount;

measuring a fifth level of current consumption after activating a fan in the warm air furnace;

comparing the fifth level of current consumption with a fifth expected level of current consumption;

detecting a fault in the warm air furnace if the comparison passes a fifth threshold amount;

measuring a sixth level of current consumption after the fan has been operating substantially longer than 30 seconds;

comparing the sixth level of current consumption with a sixth expected level of current consumption; and detecting a fault in the warm air furnace if the comparison passes a sixth threshold amount.

37. The method of claim 36, wherein the first expected level of current consumption is substantially 0.2 amps.

38. The method of claim 36, wherein the second expected level of current consumption is substantially 3 amps.

39. The method of claim 36, wherein the third expected level of current consumption is substantially 2 amps.

40. The method of claim 36, wherein the fourth expected level of current consumption is substantially 6 amps.

41. The method of claim 36, wherein the fifth expected level of current consumption is substantially 25 amps.

42. The method of claim 36, wherein the sixth expected level of current consumption is substantially 12 amps.

43. The method of claim 36, wherein a sensing circuit is operable to measure the first, second, third, fourth, fifth, and sixth current consumption levels.

44. The method of claim 36, wherein a processing device is operable to compare the first, second, third, fourth, fifth, and sixth current consumption levels with the first, second, third, fourth, fifth, and sixth expected consumption levels, respectively.

45. The method of claim 36, further comprising identifying at least one component within the warm air furnace most likely to have caused the fault.

* * * * *